US006074995A

United States Patent [19]

Dohner

[11] Patent Number: 6,074,995

[45] **Date of Patent: *Jun. 13, 2000**

[54] TRIGLYCERIDES AS FRICTION MODIFIERS IN ENGINE OIL FOR IMPROVED FUEL ECONOMY

[75] Inventor: Brent R. Dohner, Concord Township, Ohio

[73] Assignee: The Lubrizol Corporation, Wickliffe, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 07/896,073

[22] Filed: Jun. 2, 1992

[51] Int. Cl.[7] ..... C10M 129/74; C10M 129/26

[52] U.S. Cl. ..... 508/460; 508/306; 508/506; 508/491

[58] Field of Search ..... 252/33.2, 38, 39, 252/40, 41, 45, 46.3, 47.5, 48.2, 48.8, 52 R; 508/306, 460, 506, 491

[56] References Cited

U.S. PATENT DOCUMENTS

| | | | |
|---|---|---|---|
| 2,294,817 | 7/1942 | van Dijck . | |
| 2,611,742 | 9/1952 | Kipp . | |
| 3,567,637 | 3/1971 | Sabol | 508/460 |
| 3,629,109 | 12/1971 | Gergel et al. | 508/402 |
| 3,953,179 | 4/1976 | Souillard et al. . | |
| 4,100,282 | 7/1978 | Clason et al. | 514/222.2 |
| 4,134,845 | 1/1979 | Wakim . | |
| 4,304,678 | 12/1981 | Schick et al. . | |
| 4,380,499 | 4/1983 | Kammann, Jr. et al. . | |
| 4,505,829 | 3/1985 | Wisotsky . | |
| 4,663,063 | 5/1987 | Davis | 44/383 |
| 4,783,274 | 11/1988 | Jokinen et al. . | |
| 4,925,581 | 5/1990 | Erickson et al. . | |
| 4,952,328 | 8/1990 | Davis et al. . | |
| 4,957,651 | 9/1990 | Schwind . | |
| 4,965,003 | 10/1990 | Schlicht | 508/186 |
| 4,970,010 | 11/1990 | Erickson et al. . | |
| 5,064,546 | 11/1991 | Dasai . | |
| 5,144,603 | 9/1992 | Kennedy et al. | 369/44.14 |
| 5,300,242 | 4/1994 | Nichols et al. | 508/460 |
| 5,338,471 | 8/1994 | Lal | 508/469 |
| 5,427,704 | 6/1995 | Lawate | 508/491 |
| 5,508,331 | 4/1996 | Nichols et al. | 508/460 |
| 5,595,965 | 1/1997 | Wiggins | 508/491 |
| 5,858,934 | 1/1999 | Wiggins et al. | 508/491 |
| 5,958,851 | 9/1999 | Cannon et al. | 508/491 |

FOREIGN PATENT DOCUMENTS

| | | |
|---|---|---|
| 286996 | 10/1988 | European Pat. Off. . |
| 2038356 | 7/1980 | United Kingdom . |

OTHER PUBLICATIONS

Smalheer and Smith, *Lubricant Additives*, The Lezius–Hiles Co, Cleveland, OH, pp. 1–4, (1967), (month unknown).

*Primary Examiner*—Alan Diamond
*Attorney, Agent, or Firm*—David M. Shold

[57] ABSTRACT

A friction modifier composition is disclosed that comprises an oil of lubricating viscosity and containing a friction-reducing amount of an additive comprising;

(A) at least one natural oil comprising an animal oil or vegetable oil comprising a triglyceride or (A') a diglyceride and (B) at least one metal overbased composition.

8 Claims, No Drawings

TRIGLYCERIDES AS FRICTION MODIFIERS IN ENGINE OIL FOR IMPROVED FUEL ECONOMY

FILED OF THE INVENTION

The present invention relates to the reduction of friction of sliding metal surfaces in an internal combustion engine which is reduced by using a lubricating oil in the engine crank-case which contains a naturally occurring triglyceride and a metal overbased composition.

BACKGROUND OF THE INVENTION

In order to conserve energy, automobiles are now being engineered to give improved gasoline mileage. This effort is of great urgency as a result of Federal regulations enacted which compel auto manufacturers to achieve prescribed gasoline mileage. These regulations are to conserve crude oil. In an effort to achieve the required mileage, new cars are down-sized and made much lighter. However, there are limits in this approach beyond which the cars will not accommodate a typical family.

Another way to improve fuel mileage is to reduce engine friction. The present invention is concerned with this latter approach.

U.S. Pat. No. 4,970,010 (Erickson et al) Nov. 13, 1990) relates to lubricant compositions and lubricant additives and to methods for producing lubricant additives with antifriction properties that contain vegetable oil and vegetable oil derivatives as lubricating agents. More specifically, this reference relates to wax esters of vegetable oil fatty acids, sulfurized vegetable oil triglycerides, sulfurized vegetable oil wax esters, vegetable oil triglycerides, phosphite adducts of vegetable oil triglycerides, and phosphite adducts of vegetable oil wax esters as lubricant additives in various combinations, and from various vegetable oil sources.

U.S. Pat. No. 3,953,179 (Souillard et al, Apr. 27, 1976) relates to a lubricating composition for two-stroke engines which comprises 90 to 97% by weight of a lubricating mixture comprising 15 to 80% by weight of a polymer selected from the group consisting of hydrogenated and non-hydrogenated polybutene, polyisobutylene and mixtures thereof, having a mean molecular weight ranging from 250 to 2,000 and 0.5 to 10% by weight of a triglyceride of an unsaturated aliphatic acid containing 18 carbon atoms, the remainder of said mixture being a lubricating oil, and 3 to 10% by weight of lubricating oil additives for two-stroke engines.

U.K. Patent Application GB 2,038,356 based on U.S. Ser. No. 970,699 of Dec. 18, 1978, published Jul. 23, 1980 assigned to Chevron Research Company relates to the fuel economy of an internal combustion engine that is improved by incorporating in the lubricating oil used to lubricate the crankcase of said engine of from 0.25 to 2 weight percent of a fatty acid ester of glycerol, such as glycerol mono-oleate or glycerol tallowate. The fatty acid ester can be added to lubricating oil to form a lubricating oil composition.

SUMMARY OF THE INVENTION

The present invention relates to a composition comprising an oil of lubricating viscosity and containing a friction-reducing amount of an additive comprising (A) at least one natural oil comprising an animal oil or vegetable oil comprising a triglyceride of the formula

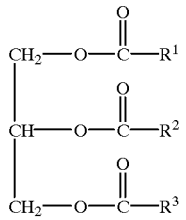

wherein $R^1$, $R^2$ and $R^3$ are independently saturated or unsaturated aliphatic hydrocarbyl groups containing from about 8 to about 24 carbon atoms and (B) at least one metal overbased composition.

In an alternative embodiment, (A) is replaced with (A'), a diglyceride of the formulae

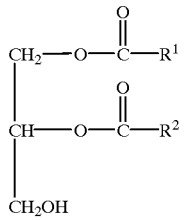

or

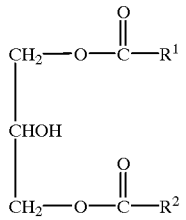

wherein $R^1$ and $R^2$ are defined as above.

DETAILED DESCRIPTION OF THE INVENTION

The oil of lubricating viscosity which is utilized in the preparation of the composition of this invention may be based on mineral lubricating oils such as liquid petroleum oils and solvent-treated or acid-treated mineral lubricating oils of the paraffinic, naphthenic or mixed paraffinic-naphthenic types, synthetic oils, or mixtures thereof. Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propylene-isobutylene copolymers, chlorinated polybutylenes, etc.); poly(1-hexenes), poly(1-octenes), poly(1-decenes), etc. and mixtures thereof; alkylbenzenes (e.g., dodecyl-benzenes, tetradecylbenzenes, dinonyl-benzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_3$–$C_8$ fatty acid esters, or the $C_{13}$ oxo acid diester of tetra-ethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) specific examples of these esters include dibutyl adipate, di(2-ethylhexyl)sebacate, di-n-hexyl fumarate, dioctyl sebacate, diiso-octyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripenta-erythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methyl-hexyl)silicate, tetra-(p-tert-butyl-phenyl)silicate, hexyl-(4-methyl-2-pentoxy) disiloxane, poly(methyl)siloxans, poly(methylphenyl) siloxanes, etc.). Other synthetic lubricating oils include liquid esters of phosphorus-containing acids (e.g., tricresyl phosphate, trioxtyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the concentrates of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil.

Refined oils are similar to the unrefined oils except they have been further treated in one or more purification steps to improve one or more properties. Many such purification techniques are known to those skilled in the art such as solvent extraction, secondary distillation, hydrotreating, hydrocracking, acid or base extraction, filtration, percolation, etc.

Rerefined oils are obtained by processes similar to those used to obtain refined oils which have been already used in service. Such rerefined oils are also known as reclaimed or reprocessed oils and often are additionally processed by techniques directed to removal of spent additives and oil breakdown products.

(A) The Natural Oil

In practicing this invention a natural oil is employed which is an animal or vegetable oil of a triglyceride of the formula (I)

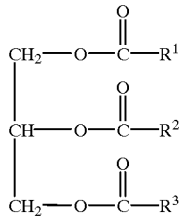

Within structure (I) $R^1$, $R^2$ and $R^3$ are hydrocarbyl groups independently containing from about 8 to about 24 carbon atoms. The term "hydrocarbyl group" as used herein denotes a radical having a carbon atom directly attached to the remainder of the molecule. Within the context of this invention, the hydrocarbyl group is of predominately aliphatic hydrocarbon character. Such aliphatic hydrocarbon groups include the following:

(1) Aliphatic hydrocarbon groups; that is, alkyl groups such as heptyl, nonyl, undecyl, tridecyl, heptadecyl; alkenyl groups containing a single double bond such as heptenyl, nonenyl, undecenyl, tridecenyl, heptadecenyl, heneiscosenyl; alkenyl groups containing 2 or 3 double bonds such as 8, 11-heptadienyl and 8, 11, 14-heptatrienyl. All isomers of these are included, but straight chain groups are preferred.

(2) Substituted aliphatic hydrocarbon groups; that is groups containing non-hydrocarbon substituents which, in the context of this invention, do not alter the predominantly hydrocarbon character of the group. Those skilled in the art will be aware of suitable substituents; examples are hydroxy, carbalkoxy (especially lower carbalkoxy) and alkoxy (especially lower alkoxy), the term, "lower" denoting groups containing not more than 7 carbon atoms.

(3) Hetero groups; that is, groups which, while having predominantly aliphatic hydrocarbon character within the context of this invention, contain atoms other than carbon present in a chain or ring otherwise composed of aliphatic carbon atoms. Suitable hetero atoms will be apparent to those skilled in the art and include, for example, oxygen and sulfur.

The hydrocarbyl groups may be saturated or unsaturated or a mixture of both. The preferred triglycerides are those in which the aliphatic groups represented by $R^1$, $R^2$ and $R^3$ have from about 8 to about 24 carbon atoms. Typical triglycerides employed within the instant invention include coconut oil, safflower oil, sunflower oil, rapeseed oil, (both high erucic and low erucic acid), high oleic sunflower oil, cottonseed oil, peanut oil, corn oil, sunflower oil, safflower oil, soybean oil, palm oil, sesame oil, as well as animal oils and fats having the prescribed structure formula (I), such as lard oil and beef tallow. It is preferred that the triglyceride be of a vegetable oil.

The naturally occurring triglycerides are not chemically pure. That is, while soybean oil satisfies a parameter of structure (I) wherein $R^1$, $R^2$ and $R^3$ contain from about 8 to 24 carbon atoms, soybean oil contains a mixture of fatty acids of different carbon lengths incorporated into a triglyceride structure. Table I outlines the composition of a few natural oils which are triglycerides.

TABLE I

| Name of Fatty Acid | Cottonseed Oil | Coconut Oil | Corn Oil | Castor Oil | Rapeseed Oil Low Erucic | Rapeseed Oil High Erucic | Soybean Oil | High Oleic Sunflower Oil | Tallow Oil | Olive Oil |
|---|---|---|---|---|---|---|---|---|---|---|
| | % Fatty Acid Composition of Selected Oils | | | | | | | | | |
| Caproic | — | 0–1 | — | — | — | — | — | — | — | — |
| Caprylic | — | 5–10 | — | — | — | — | — | — | — | — |
| Capric | — | 5–10 | — | — | — | — | — | — | — | — |
| Lauric | — | 43–53 | 0–1 | — | — | — | — | — | — | — |
| Myristic | 0–2 | 15–21 | — | — | T | T | T | — | 1–6 | 0–1 |
| Palmitic | 17–29 | 7–11 | 8–19 | 2–3 | 3–6 | 0–5 | 7–12 | 3–4 | 20–37 | 7–16 |
| Stearic | 1–4 | 2–4 | 0–4 | 2–3 | 0–3 | 0–3 | 2–6 | 4–5 | 6–40 | 1–3 |
| Arachidic | 0–1 | — | — | — | 0–2 | 0–2 | 0–3 | 1 | T | 0–1 |
| Behenic | T | — | — | — | T | 0–2 | T | 1 | — | — |
| Lignoceric | T | — | — | — | T | T | — | — | — | — |
| Lauroleic | — | — | — | — | — | — | — | — | — | — |
| Myristoleic | — | — | — | — | — | — | — | — | — | — |
| Palmitoleic | 0–2 | — | — | — | T | T | T | — | 1–9 | — |
| Oleic | 13–44 | 6–8 | 19–50 | 4–9 | 50–66 | 9–25 | 20–30 | 80 | 20–50 | 65–85 |
| Gadoleic | T | — | — | — | 0–5 | 5–15 | 0–1 | — | — | — |
| Erucic | — | — | — | — | 0–5 | 30–60 | — | — | — | — |
| Ricinoleic | — | — | — | 80–87 | — | — | — | — | — | — |
| Linoleic | 33–58 | 1–3 | 34–62 | 2–7 | 18–30 | 11–25 | 48–58 | 9–10 | 0–5 | 4–15 |
| Linolenic | — | — | 0–2 | — | 6–14 | 5–12 | 4–10 | — | 0–3 | 0–1 |

Some of the preferred vegetable oils of this invention are high oleic sunflower oil, high oleic being defined as containing at least 70% oleic content, obtained from sunflower (Helianthus sp.) available from SVO Enterprises, Eastlake, Ohio as Sunyl® high oleic sunflower oil and sunflower oil.

An alternative embodiment involves replacing the (A) Natural Oil with (A') a Diglyceride of the formulae

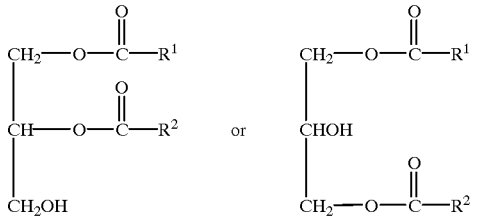

wherein $R^1$ and $R^2$ are defined within (A).

(B) The Metal Overbased Composition

Overbased salts of organic acids are widely known to those of skill in the art and generally include metal salts wherein the amount of metal present in them exceeds the stoichiometric amount. Such salts are said to have conversion levels in excess of 100% (i.e., they comprise more than 100% of the theoretical amount of metal needed to convert the acid to its "normal" "neutral" salt). Such salts are often said to have metal ratios in excess of one (i.e., the ratio of equivalents of metal to equivalents of organic acid present in the salt is greater than that required to provide the normal or neutral salt which required only a stoichiometric ratio of 1:1). They are commonly referred to as overbased, hyperbased or superbased salts and are usually salts of organic sulfur acids, organic phosphorus acids, carboxylic acids, phenols or mixtures of two or more of any of these. As a skilled worker would realize, mixtures of such overbased salts can also be used.

The terminology "metal ratio" is used in the prior art and herein to designate the ratio of the total chemical equivalents of the metal in the overbased salt to the chemical equivalents of the metal in the salt which would be expected to result in the reaction between the organic acid to be overbased and the basically reacting metal compound according to the known chemical reactivity and stoichiometry of the two reactants. Thus, in a normal or neutral salt the metal ratio is one and in an overbased salt the metal ratio is greater than one.

The metal overbased salts used as (B) in this invention usually have metal ratios of at least about 2:1. Typically, they have ratios of at least about 12:1. Usually they have metal ratios not exceeding about 40:1. Typically salts having ratios of about 12:1 to about 20:1 are used.

The basically reacting metal compounds used to make these overbased salts are usually an alkali or alkaline earth metal compound (i.e., the Group IA, and IIA metals excluding francium and radium and typically excluding rubidium, cesium and beryllium) although other basically reacting metal compounds can be used. Compounds of Ca, Ba, Mg, Na and Li, such as their hydroxides and alkoxides of lower alkanols are usually used as basic metal compounds in preparing these overbased salts but others can be used as shown by the art incorporated by reference herein. Overbased salts containing a mixture of ions of two or more of these metals can be used in the present invention.

These overbased salts can be of oil-soluble organic sulfur acids such as sulfonic, sulfamic, thiosulfonic, sulfinic, sulfenic, partial ester sulfuric, sulfurous and thiosulfuric acid. Generally they are salts of carbocylic or aliphatic sulfonic acids.

The carbocylic sulfonic acids include the mono- or polynuclear aromatic or cycloaliphatic compounds. The oil-soluble sulfonates can be represented for the most part by the following formulae:

$$[(R^4)_x—T—(SO_3)_y]_zM_b \quad \text{(II)}$$

$$[R^5—(SO_3)_a]_dM_b \quad \text{(III)}$$

In the above formulae, M is either a metal cation as described hereinabove or hydrogen; T is a cyclic nucleus such as, for example, benzene, naphthalene, anthracene, phenanthrene, diphenylene oxide, thianthrene, phenothioxine, diphenylene sulfide, phenothiazine, diphenyl oxide, diphenyl sulfide, diphenylamine, cyclohexane, petroleum naphthenes, decahydro-naphthalene, cyclopentane, etc.: $R^4$ in Formula II is an aliphatic group such as alkyl, alkenyl, alkoxy, alkoxyalkyl, carboalkoxyalkyl, etc; x is at least 1, and $(R^4)_x$+T contains a total of at least about 20 and preferably 30 carbon atoms, $R^5$ in Formula III is an aliphatic radical containing at least about 20 and preferably 30 carbon atoms and M is either a metal cation or hydrogen. Examples of type of the $R^5$ radical are alkyl, alkenyl, alkoxyalkyl, carboalkoxyalkyl, etc. Specific examples of $R^5$ are groups derived from petrolatum, saturated and unsaturated paraffin wax, and polyolefins, including polymerized $C_2$, $C_3$, $C_4$, $C_5$, $C_6$, etc., olefins containing from about 15 to 7000 or more carbon atoms. The groups T, R, and $R^5$ in the above formulae can also contain other inorganic or organic substituents in addition to those enumerated above such as, for example, hydroxy, mercapto, halogen, nitro, amino, nitroso, sulfide, disulfide, etc. In Formula II, x, y, z and b are at least 1, and likewise in Formula III, a, b and d are at least 1.

Specific examples of sulfonic acids useful in this invention are mahogany sulfonic acids; bright stock sulfonic acids; sulfonic acids derived from lubricating oil fractions having a Saybolt viscosity from about 100 seconds at 100° F. to about 200 seconds are 210° F.; petrolatum sulfonic acids; mono- and poly-wax substituted sulfonic and polysulfonic acids of, e.g., benzene, naphthalene, phenol, diphenyl ether, napthalene disulfide, diphenylamine, thiophene, alpha-chloronaphthalene, etc.; other substituted sulfonic acids such as alkyl benzene sulfonic acids (where the alkyl group has at least 20 and preferably 30 carbon atoms), cetylphenol mono-sulfide sulfonic acids, dicetyl thianthrene disulfonic acids, dilauryl beta naphthyl sulfonic acid, dicapryl nitronaphthalene sulfonic acids, and alkaryl sulfonic acids such as dodecyl benzene "bottoms" sulfonic acids.

The latter acids derived from benzene which has been alkylated with propylene tetramers or isobutene trimers to introduce 1,2,3, or more branched-chain $C_{12}$ substituents on the benzene ring. Dodecyl benzene bottoms, principally mixtures of mono-and di-dodecyl benzenes, are available as by-products from the manufacture of household detergents. Similar products obtained from alkylation bottoms formed during manufacture of linear alkyl sulfonates (LAS) are also useful in making the sulfonates used in this invention.

The production of sulfonates from detergent manufacture-by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 at seq. published by John Wiley & Sons, New York (1969).

Other descriptions of overbased sulfonate salts and techniques for making them can be found in the following U.S. Pat. Nos. 2,174,110; 2,174,506; 2,174,508; 2,193,824; 2,197,800; 2,202,781; 2,212,786; 2,213,360; 2,228,598; 2,223,676; 2,239,974; 2,263,312; 2,276,090; 2,276,297; 2,315,514; 2,319,121; 2,321,022; 2,333,568; 2,333,788; 2,335,259; 2,337,552; 2,346,568; 2,366,027; 2,374,193; 2,383,319; 3,312,618; 3,471,403; 3,488,284; 3.595,790; and 3,798,012. These are hereby incorporated by reference for their disclosures in this regard.

Also included are aliphatic sulfonic acids such as paraffin wax sulfonic acids, unsaturated paraffin wax sulfonic acids, hydroxy-substituted paraffin wax sulfonic acids, hexapropylene sulfonic acids, tetra-amylene sulfonic acids, polyisobutene sulfonic acids wherein the polyisobutene contains from 20 to 7000 or more carbon atoms, chloro-substituted paraffin wax sulfonic acids, nitroparaffin wax sulfonic acids, etc.; cycloaliphatic sulfonic acids such as petroleum naphthene sulfonic acids, cetyl cyclopentyl sulfonic acids, lauryl cyclohexyl sulfonic acids, bis-(di-isobutyl) cyclohexyl sulfonic acids, etc.

With respect to the sulfonic acids or salts thereof described herein and in the appended claims, it is intended that the term "petroleum sulfonic acids" or "petroleum sulfonates" includes all sulfonic acids or the salts thereof derived from petroleum products. A particularly valuable group of petroleum sulfonic acids are the mahogany sulfonic acids (so called because of their reddish-brown color) obtained as a by-product from the manufacture of petroleum white oils by a sulfuric acid process.

Generally Group IA and IIA overbased salts of the above-described synthetic and petroleum sulfonic acids are typically useful in making (B) of this invention.

The carboxylic acids from which suitable overbased salts for use in this invention can be made include aliphatic, cycloaliphatic, and aromatic mono- and polybasic carboxylic acids such as the napthenic acids, alkyl- or alkenyl-substituted cyclopentanoic acids, alkyl- or alkenyl-substituted cyclohexanoic acids, alkyl- or alkenyl-substituted aromatic carboxylic acids. The aliphatic acids generally contain at least 16 carbon atoms. Usually they have no more than about 400 carbon atoms. Generally, if the aliphatic carbon chain is branched, the acids are more oil-soluble for any given carbon atoms content. The cycloaliphatic and aliphatic carboxylic acids can be saturated or unsaturated. Specific examples include 2-ethylhexanoic acid, a-linolenic acid, propylene-tetramer-substituted maleic acid, behenic acid, isostearic acid, pelargonic acid, capric acid, palmitoleic acid, linoleic acid, lauric acid, oleic acid, ricinoleic acid, undecylic acid, dioctylcyclopentane carboxylic acid, myristic acid, dilauryldecahydronaphthalene carboxylic acid, stearyloctahydroindene carboxylic acid, palmitic acid, commercially available mixtures of two or more carboxylic acids such as tall oil acids, rosin acids, and the like.

A typical group of oil-soluble carboxylic acids useful in preparing the salts used in the present invention are the oil-soluble aromatic carboxylic acids. These acids are represented by the general formula:

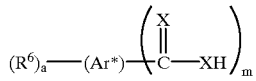

(IV)

wherein $R^6$ is an aliphatic hydrocarbon-based group of at least 16 carbon atoms, and no more than about 400 aliphatic carbon atoms, a is an integer from one to four, Ar* is a polyvalent aromatic hydrocarbon nucleus of up to about 14 carbon atoms, each X is independently a sulfur or oxygen atom, and m is an integer of from one to four. Examples of aromatic nuclei represented by the variable Ar* are the polyvalent aromatic radicals derived from benzene, napthalene anthracene, phenanthrene, indene, fluorene, biphenyl, and the like. Generally, the radical represented by Ar* will be a polyvalent nucleus derived from benzene or naphthalene such as phenylenes and naphthylene, e.g., methyphenylenes, ethoxyphenylenes, nitrophenylenes, isopropylenes, hydroxyphenylenes, mercaptophenylenes, N,N-diethylaminophenylenes, chlorophenylenes, dipropoxynaphthylenes, triethylnaphthylenes, and similar tri-, tetra-, pentavalent nuclei thereof, etc.

The $R^6$ groups are usually hydrocarbyl groups, preferably groups such as alkyl or alkenyl radicals. However, the $R^6$ groups can contain small number substituents such as phenyl, cycloalkyl (e.g., cyclohexyl, cyclopentyl, etc.) and nonhydrocarbon groups such as nitro, amino, halo (e.g., chloro, bromo, etc.), lower alkoxy, lower alkyl mercapto, oxo substituents (i.e., =O), thio groups (i.e., =S), interrupting groups such as —NH—, —O—, —S—, and the like provided the essentially hydrocarbon character of the $R^6$ group is retained. The hydrocarbon character is retained for purposes of this invention so long as any non-carbon atoms present in the $R^6$ groups do not account for more than about 10% of the total weight of the $R^6$ groups.

Examples of $R^6$ groups include palmityl, stearyl, docosyl, tetracontyl, and substituents derived from polymerized olefins such as polychloroprenes, polyethylenes, polypropylenes, polyisobutylenes, ethylene-propylene copolymers, chlorinated olefin polymers, oxidized ethylene-propylene copolymers, and the like. Likewise, the group Ar* may contain non-hydrocarbon substituents, for example, such diverse substituents as lower alkoxy, lower alkyl mercapto, nitro, halo, alkyl or alkenyl groups of less than 4 carbon atoms, hydroxy, mercapto, and the like.

Another group of useful carboxylic acids are those of the formula:

(V)

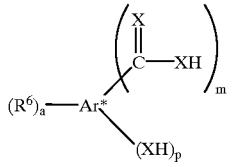

wherein $R^6$, X, Ar*, m and a are as defined in Formula IV and p is an integer of 1 to 4, usually 1 or 2. Within this group, an especially preferred class of oil-soluble carboxylic acids are those of the formula:

(VI)

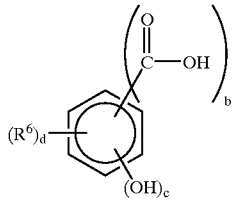

wherein $R^6$ is defined as above, d is an integer of from 1 to 3, b is 1 or 2, c is zero, 1, or 2 and preferably 1. And within this latter group of oil-soluble carboxylic acids, the aliphatic-hydrocarbon substituted salicyclic acids wherein each aliphatic hydrocarbon substituent contains an average of at least about 16 carbon atoms per substituent and 1 to 3 substituents per molecule are particularly useful. Salts prepared from such salicyclic acids wherein the aliphatic hydrocarbon substituents are derived from polymerized olefins, particularly polymerized lower 1-mono-olefins such as polyethylene, polypropylene, polyisobutylene, ethylene/-propylene copolymers and the like and having average carbon contents of about 30 to about 400 carbon atoms.

The carboxylic acids corresponding to Formulae IV–V above are well known or can be prepared according to procedures known in the art. Carboxylic acids of the type illustrated by the above formulae and processes for preparing their overbased metal salts are well known and disclosed, for example, in such as U.S. Pat. Nos. 2,197,832; 2,197,835; 2,252,662; 2,252,664; 2,714,092; 3,410,798 and 3,595,791 which are incorporated by reference herein for their disclosures of acids and methods of preparing overbased salts.

Another type of overbased carboxylate salt used in making (B) of this invention are those derived from alkenyl succinates of the general formula:

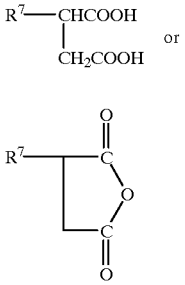

(VII)

wherein $R^7$ is derived from a polyalkene. The polyalkene is characterized as containing from at least about 45, preferably at least about 50, more preferably about 60, up to about 300 carbon atoms, generally about 200, preferably about 100, more preferably about 80. In one embodiment, the polyalkene is characterized by an Mn (number average molecular weight) value of at least about 600. Generally, the polyalkene is characterized by an Mn value of about 600, preferably about 700, more preferably about 800, still more preferably about 900 up to about 5000, preferably 2500, more preferably 2000, still more preferably about 1500. In another embodiment Mn varies between about 600, preferably about 700, more preferably about 800 to about 1200 or 1300.

The abbreviation Mn is the conventional symbol representing number average molecular weight. Gel permeation chromatography (GPC) is a method which provides both weight average and number average molecular weights as well as the enire molecular weight distribution of the polymers. For purpose of this invention a series of fractionated polymers of isobutene, polyisobutene, is used as the calibration standard in the GPC.

The techniques for determining Mn and Mw values of polymers are well known and are described in numerous books and articles. For example, methods for the determination of Mn and molecular weight distribution of polymers is described in W. W. Yan, J. J. Kirkland and D. D. Bly, "Modern Size Exclusion Liquid Chromatographs", J. Wiley & Sons, Inc., 1979.

The polyalkenes include homopolymers and interpolymers of polymerizable olefin monomers of 2 to about 16 carbon atoms; usually 2 to about 6, preferably 2 to about 4, more preferably 4. The olefins may be mono-olefins such as ethylene, propylene, 1-butene, isobutene, and 1-octene; or a polyolefinic monomer, preferably diolefinic monomer, such as 1,3-butadiene and isoprene. The polyalkenes are prepared by conventional procedures.

Illustrative carboxylic acids include polybutenyl-substituted succinic acids derived from a polybutene (Mn equals about 200–1500, preferably about 300–1500), propenyl-substituted succinic acids derived from polypropylenes (Mn equals 200–1000) acids, acids formed by oxidation of petrolatum or of hydrocarbon waxes, available mixtures of two or more carboxylic acids and mixtures of these acids, their metal salts, and/or their anhydrides.

Other patents specifically describing techniques for making overbased salts of the hereinabove-described sulfonic acids, carboxylic acids, and mixtures of any two or more of these include U.S. Pat. Nos. 2,501,731; 2,616,904; 2,616,905; 2,616,906; 2,616,911; 2,616,924; 2,616,925; 2,617,049; 2,777,874; 3,027,325; 3,256,186; 3,282,835; 3,384, 585; 3,373,108; 3,365,296; 3,342,733; 3,320,162; 3,312,618; 3,318,809; 3,471,403; 3,488,284; 3,595,790; and 3,629,109. The disclosures of these patents are hereby incorporated in this present specification for their disclosures in this regard as well as for their disclosure of specific suitable basic metal salts.

In the context of this invention, phenols are considered organic acids. Thus, overbased salts of phenols (generally known as phenates) are also useful in making (B) of this invention are well known to those skilled in the art. The phenols from which these phenates are formed are of the general formula:

$$(R^6)_a(Ar^*)—(XH)_m \quad \text{(VIII)}$$

wherein $R^6$, a, Ar*, X and m have the same meaning and preferences are described hereinabove with reference to Formula IV. The same examples described with respect to Formula IV also apply.

A commonly available class of phenates are those made from phenols of the general formula:

(IX)

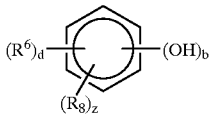

wherein d is an integer of 1–3, b is of 1 or 2, z is 0 or 1, $R^6$ in Formula IX is a hydrocarbyl-based substituent having an average of from 16 to about 400 aliphatic carbon atoms and $R^8$ is selected from the group consisting of lower hydrocarbyl, lower alkoxyl, nitro, amino, cyano and halo groups.

One particular class of phenates for use in this invention are the overbased, Group IIA metal sulfurized phenates made by sulfurizing a phenol as described hereinabove with a sulfurizing agent such as sulfur, a sulfur halide, or sulfide or hydrosulfide salt. Techniques for making these sulfurized phenates are described in U.S. Pat. Nos. 2,680,096; 3,036,971; and 3,775,321 which are hereby incorporated by reference for their disclosures in this regard.

Other phenates that are useful are those that are made from phenols that have been linked through alkylene (e.g., methylene) bridges. These are made by reacting single or multi-ring phenols with aldehydes or ketones, typically, in the presence of an acid or basic catalyst. Such linked phenates as well as sulfurized phenates are described in detail in U.S. Pat. No. 3,350,038; particularly columns 6–8 thereof, which is hereby incorporated by reference for its disclosures in this regard.

Component B may also be a borated complex of an alkali overbased metal salt such as described hereinabove. Borated complexes of this type may be prepared by heating the basic alkali metal salt with boric acid at about 50°–100° C., the number of equivalents of boric acid being roughly equal to the number of equivalents of alkali metal in the salt. U.S. Pat. No. 3,929,650 is incorporated by reference herein for its disclosure of borated complexes.

Generally Group IIA overbased salts of the above-described carboxylic acids are typically useful in making (B) of this invention.

The method of preparing metal overbased compositions in this manner is illustrated by the following examples.

EXAMPLE B-1

A mixture consisting essentially of 480 parts of a sodium petrosulfonate (average molecular weight of about 480), 84 parts of water, and 520 parts of mineral oil is heated at 100° C. The mixture is then heated with 86 parts of a 76% aqueous solution of calcium chloride and 72 parts of lime (90% purity) at 100° C. for two hours, dehydrated by heating to a water content of less than about 0.5%, cooled to 50°0C., mixed with 130 parts of methyl alcohol, and then blown with carbon dioxide at 50° C. until substantially neutral. The mixture is then heated to 150° C. to distill off methyl alcohol and water and the resulting oil solution of the basic calcium sulfonate filtered. The filtrate is found to have a calcium sulfate ash content of 16% and a metal ratio of 2.5. A mixture of 1305 parts of the above carbonated calcium petrosulfonate, 930 parts of mineral oil, 220 parts of methyl alcohol, 72 parts of isobutyl alcohol, and 38 parts of amyl alcohol is prepared, heated to 35° C., and subjected to the following operating cycle four times: mixing with 143 parts of 90% commercial calcium hydroxide (90% calcium hydroxide) and treating the mixture with carbon dioxide until it has a base number of 32–39. The resulting product is then heated to 155° C. during a period of nine hours to remove the alcohol and filtered at this temperature. The filtrate is characterized by a calcium sulfate ash content of about 40% and a metal ratio of about 12.2.

EXAMPLE B-2

A mineral oil solution of a basic, carbonated calcium complex is prepared by carbonating a mixture of an alkylated benzene sulfonic acid (molecular weight of 470) an alkylated calcium phenate, a mixture of lower alcohols (methanol, butanol, and pentanol) and excess lime (5.6 equivalents per equivalent of the acid). The solution has a sulfur content of 1.7%, a calcium content of 12.6% and a base number of 336. To 950 grams of the solution, there is added 50 grams of a polyisobutene (molecular weight of 1000)-substituted succinic anhydride (having a saponification number of 100) at 25° C. The mixture is stirred, heated to 150° C., held at that temperature for 0.5 hour, and filtered. The filtrate has a base number of 315 and contains 35.4% of mineral oil.

EXAMPLE B-3

To 950 grams of a solution of a basic, carbonated, calcium salt of an alkylated benzene sulfonic acid (average molecular weight—425) in mineral oil (base number—406, calcium—15.2% and sulfur—1.4%) there is added 50 grams of the polyisobutenyl succinic anhydride of Example B-2 at 57° C. The mixture is stirred for 0.65 hour at 55°–57° C., then at 152°–153° C. for 0.5 hour and filtered at 105° C. The filtrate has a base number of 387 and contains 43.7% of mineral oil.

EXAMPLE B-4

A mixture comprising 753 parts (by weight) of mineral oil, 1440 parts of xylene, 84 parts of a mixture of a commercial fatty acid mixture (acid number of 200, 590 parts of an alkylated benzene sulfonic acid (average molecular weight—500), and 263 parts of magnesium oxide is heated to 60° C. Methanol (360 parts) and water (180 parts) are added. The mixture is carbonated at 65° C.–98° C. while methanol and water are being removed by azeotropic distillation. Additional water (180 parts) is then added and carbonation is continued at 87°–90° C. for three and a half hours. Thereafter, the reaction mixture is heated to 160° C. at 20 torr and filtered at 160° C. to give a basic, carbonated magnesium sulfonate-carboxylate complex (78.1% yield) containing 7.69% of magnesium and 1.67% of sulfur and having a base number of 336. To 950 parts of the above basic, carbonated magnesium complex, there is added 50 parts of the polyisobutenyl complex, there is added 50 parts of the polyisobutenyl succinic anhydride of Example B-2 and the mixture is heated to 150° C. for one-half hour and then filtered to give a composition having a base number of 315.

EXAMPLE B-5

A mixture comprising 906 grams (1.5 equivalents) of an oil solution of an alkylbenzene sulfonic acid (average molecular weight—460–480), 564 grams of mineral oil, 600 grams of toluene, 95.7 grams of magnesium oxide (4.4 equivalents), and 120 grams of water is carbonated at a temperature of about 78°–85° C. for about 7 hours at a rate of about 3 cubic feet of carbon dioxide per hour. The carbonated product is stripped by heating to 165° C. at a pressure of 20 torr and filtered. The filtrate is an oil solution of a basic, carbonated magnesium sulfonate complex having a metal ratio of 3.1 and containing 15.27% of magnesium sulfate ash, 2.66% of sulfur and a base number of 98. To 95 grams of this complex there is added 5 grams of the polyisobutenyl succinic anhydride of Example B-2 and the mixture is stirred at 150° C. and filtered.

EXAMPLE B-6

A mixture of 2,576 grams of mineral oil, 240 grams (1.85 equivalents) of octyl alcohol, 740 grams (20.0 equivalents) of calcium hydroxide, 2304 grams (8 equivalents) of oleic acid, and 392 grams (12.3 equivalents) of methyl alcohol is heated with stirring to a temperature about 50° C. in about 0.5 hour. This mixture then is treated with $CO_2$ (3 cubic feet per hour) at 50°–60° C. for a period of about 3.5 hours. The resulting mixture is heated to 150° C. and filtered. The filtrate is a basic calcium oleate complex having the following analyses:

Sulfate ash (%) 24.1

Metal ratio 2.5

Neutralization No. (acidic) 2.0

EXAMPLE B-7

A reaction mixture comprising 1044 grams (about 1.5 equivalents) of an oil solution of an alkylphenyl sulfonic acid (average molecular weight—500), 1200 grams of mineral 981, 2400 grams of xylene, 138 grams (about 0.5 equivalents) of tall oil acid mixture (oil-soluble fatty acid mixture sold by Hercules under the name PAMAK-4), 434 grams (20 equivalents) of magnesium oxide, 600 grams of methanol, and 300 grams of water is carbonated at a rate of 6 cubic feet of carbon dioxide per hour at 65°–70° C. (methanol reflux). The carbon dioxide introduction rate was decreased as the carbon dioxide uptake diminished. After 2.5 hours of carbonation, the methanol is removed and by raising the temperature of the mixture to about 95° C. with continued carbon dioxide blowing at a rate of about two cubic feet per hour for one hour. Then 300 grams of water is added to the reaction mixture and carbonation was continued at about 90° C. (reflux) for about four hours. The material becomes hazy with the addition of the water but clarifies after 2–3 hours of continued carbonation. The carbonated product is then stripped to 160° C. at 20 torr and filtered. The filtrate is a concentrated oil solution (47.5% oil) of the desired basic magnesium salt, the salt being characterized by a metal ratio of about 10.

EXAMPLE B-8

Following the general procedure of Example B-7 but adjusting the weight ratio of methanol to water in the initial reaction mixture to 4:3 in lieu of the 2:1 ratio of Example B-7 another concentrated oil-solution (57.5% oil) of a basic magnesium salt is produced. This methanol-water ratio gives improved carbonation at the methanol reflux stage of carbonation and prevents thickening of the mixture during the 90° C. carbonation stage.

EXAMPLE B-9

A reaction mixture comprising 135 parts mineral oil, 330 parts xylene, 200 parts (0.235 equivalent) of a mineral oil solution of an alkylphenylsulfonic acid (average molecular weight—425), 19 parts (0.068 equivalent) of the above-described mixture of tall oil acids, 60 parts (about 2.75 equivalents) of magnesium oxide, 83 parts methanol, and 62 parts water are carbonated at a rate of 15 parts of carbon dioxide per hour for about 2 hours at the methanol reflux temperature. The carbon dioxide inlet rate is then reduced to about 7 parts per hour and the methanol is removed by raising the temperature to about 98° C. over a 3 hour period. Then 47 parts of water are added and carbonation is continued for an additional 35. hours at a temperature of about 95° C. The carbonated mixture is then stripped by heating to a temperature of 140°–145° C. over a 2.5 hour period. This results in an oil solution of a basic magnesium salt characterized by a metal ratio of about 10.

Then, the carbonated mixture is cooled to about 60°–65° C. and 208 parts xylene, 60 parts magnesium oxide, 83 parts methanol and 62 parts water are added thereto. Carbonation is resumed at a rate of 15 parts per hour for 2 hours at the methanol reflux temperature. The carbon dioxide addition rate is reduced to 7 parts per hour and the methanol is removed by raising the temperature to about 95° C. over a 3 hour period. An additional 41.5 parts of water are added and carbonation is continued at 7 parts per hour at a temperature of about 90°–95° C. for 3.5 hours. The carbonated mass is then heated to about 150°–160° C. over a 3.5-hour period and then further stripped by reducing the pressure to 20 torr at this temperature. The carbonated reaction product is then filtered. The filtrate is a concentrated oil-solution (31.6% oil) of the desired basic magnesium salt characterized by a metal ratio of 20.

EXAMPLE B-10

To a solution of 790 parts (1 equivalent) of an alkylated benzenesulfonic acid and 71 parts of polybutenyl succinic anhydride (equivalent weight about 560) containing predominantly isobutene units in 176 parts of mineral oil is added 320 parts (8 equivalents) of sodium hydroxide and 640 parts (20 equivalents) of methanol. The temperature of the mixture increases to 89° C. (reflux) over 10 minutes due to exotherming. During this period, the mixture is blown with carbon dioxide at 4 cfh. (cubic feet/hr.). Carbonation is continued for about 30 minutes as the temperature gradually decreases to 74° C. The methanol and other volatile materials are stripped from the carbonated mixture by blowing nitrogen through it at 2 cfh. while the temperature is slowly increased to 150° C. over 90 minutes. After stripping is completed, the remaining mixture is held at 155–165° C. for about 30 minutes and filtered to yield an oil solution of the desired basic sodium sulfonate having a metal ratio of about 7.75. This solution contains 12.4% oil.

EXAMPLE B-11

Following the procedure of Example B-10, a solution of 780 parts (1 equivalent) of an alkylated benzenesulfonic acid and 119 parts of the polybutenyl succinic anhydride in 442 parts of mineral oil is mixed with 800 parts (20 equivalents) of sodium hydroxide and 704 parts (22 equivalents) of methanol. The mixture is blown with carbon dioxide at 7 cfh. for 11 minutes as the temperature slowly increases to 95° C. The rate of carbon dioxide flow is reduced to 6 cfh. and the temperature decreases slowly to 88° C. over about 40 minutes. The rate of carbon dioxide flow is reduced to 5 cfh. for about 35 minutes and the temperature slowly decreases to 73° C. The volatile materials are stripped by blowing nitrogen through the carbonated mixture at 2 cfh. for 105 minutes as the temperature is slowly increased to 160° C. After stripping is completed, the mixture is held at 160° C. for an additional 45 minutes and then filtered to yield an oil solution of the desired basic sodium sulfonate having a metal ratio of about 19.75. This solution contains 18.7% oil.

EXAMPLE B-12

Following the procedure of Example B-10, a solution of 780 parts (1 equivalent) of an alkylated benzenesulfonic acid and 86 parts of the polybutenyl succinic anhydride in 254 parts of mineral oil is mixed with 480 parts (12 equivalents) of sodium hydroxide and 640 parts (20 equivalents) of methanol. The reaction mixture is blown with carbon dioxide at 6 cfh. for about 45 minutes. During this time the temperature increases to 95° C. and then gradually decreases to 74° C. The volatile material is stripped by blowing with nitrogen gas at 2 cfh. for about one hour as the temperature is increased to 160° C. After stripping is complete the mixture is held at 160° C. for 0.5 hour and then filtered to yield an oil solution of the desired sodium salt, having a metal ratio of 11.8. The oil content of this solution is 14.7%.

EXAMPLE B-13

Following the procedure of Example B-10, a solution of 2800 parts (3.5 equivalents) of an alkylated benzenesulfonic acid and 302 parts of the polybutenyl succinic anhydride in 818 parts of mineral oil is mixed with 1680 parts (42 equivalents) of sodium hydroxide and 2240 parts (70 equivalents) of methanol. The mixture is blown with carbon dioxide for about 90 minutes at 10 cfh. During this period, the temperature increases to 96° C. and then slowly drops to 76° C. The volatile materials are stripped by blowing with nitrogen at 2 cfh. as the temperature is slowly increased from 76° C. to 165° C. by external heating. Water is removed by vacuum stripping. Upon filtration, an oil solution of the desired basic sodium salt is obtained. It has a metal ratio of about 10.8 and the oil content is 13.6%.

EXAMPLE B-14

Following the procedure of Example B-10 a solution of 780 parts (1.0 equivalent) of an alkylated benzenesulfonic acid and 103 parts of the polybutenyl succinic anhydride in 350 parts of mineral oil is mixed with 640 parts (16 equivalents of sodium hydroxide and 640 parts (20 equivalents) of methanol. This mixture is blown with carbon dioxide for about one hour at 6 cfh. During this period, the temperature increases to 95° C. and then gradually decreases to 75° C. The volatile material is stripped by blowing with nitrogen. During stripping, the temperature initially drops to 70° C. over 30 minutes and then slowly rises to 78° C. over 15 minutes. The mixture is then heated to 155° C. over 80 minutes. The stripped mixture is heated for an additional 30 minutes 15 155–160° C. and filtered. The filtrate is an oil solution of the desired basic sodium sulfonate, having a metal ratio of about 15.2. It has an oil content of 17.1%.

EXAMPLE B-15

Following the procedure of Example B-10, a solution of 780 parts (1 equivalent) of an alkylated benzenesulfonic acid and 119 parts of the polybutenyl succinic anhydride in 442 parts of mineral oil is mixed well with 800 parts (10 equivalents) of sodium hydroxide and 640 parts (20 equivalents) of methanol. This mixture is blown with carbon dioxide for about 55 minutes at 8 cfh. During this period, the temperature of the mixture increases to 95° C. and then slowly decreases to 67° C. The methanol and water are stripped by blowing with nitrogen at 2 cfh. for about 40 minutes while the temperature is slowly increased to 160° C. After stripping, the temperature of the mixture is maintained at 160–165° C. for about 30 minutes. The product is then filtered to give a solution of the corresponding sodium sulfonate having a metal ratio of about 16.8. This solution contains 18.7% oil.

EXAMPLE B-16

Following the procedure of Example B-10, 836 parts (1 equivalent) of a sodium petroleum sulfonate (sodium "Petronate") in an oil solution containing 48% oil and 63 parts of the polybutenyl succinic anhydride is heated to 60° C. and treated with 280 parts (7.0 equivalents) of sodium hydroxide and 320 parts (10 equivalents) of methanol. The reaction mixture is blown with carbon dioxide at 4 cfh. for about 45 minutes. During this time, the temperature increases to 85° C. and then slowly decreases to 74° C. The volatile material is stripped by blowing with nitrogen at 1 cfh. while the temperature is gradually increased to 160° C. After stripping is completed, the mixture is heated an additional 30 minutes at 160° C. and then is filtered to yield the sodium salt in solution. The product has a metal ratio of 8.0 and an oil content of 22.2%.

EXAMPLE B-17

To a mixture comprising 125 parts of low viscosity mineral oil and 66.5 parts of heptylphenol heated to about 38° C. there is added 3.5 parts of water. Thereafter, 16 parts of paraformaldehyde are added to the mixture at a uniform rate over 0.75 hour. Then 0.5 parts of hydrated lime are added and this mixture is heated to 80° C. over a 1 hour period. The reaction mixture thickens and the temperature rises to about 116° C. Then, 13.8 parts of hydrated lime are added over 0.75 hour while maintaining a temperature of about 80°–90° C. The material is then heated to about 140° C. for 6 to 7 hours at a reduced pressure of about 2–8 torr to remove substantially all water. An additional 40 parts of mineral oil are added to the reaction product and the resulting material is filtered. The filtrate is a concentrated oil solution (70% oil) of the substantially neutral calcium salt of the heptylphenol-formaldehyde condensation product. It is characterized by calcium content of about 2.2% and a sulfate ash content of 7.5%.

EXAMPLE B-18

A solution of 3192 parts (12 equivalents) of a polyisobutene-substituted phenol, wherein the polyisobutene substituent has a molecular weight of about 175, in 2400 parts of mineral is heated to 70° C. and 502 parts (12 equivalents) of solid sodium hydroxide is added. The material is blown with nitrogen at 162° C. under vacuum to remove volatiles and is then cooled to 125° C. and 465 parts (12 equivalents of 40% aqueous formaldehyde is added. The mixture is heated to 146° C. under nitrogen, and volatiles are finally removed again under vacuum. Sulfur dichloride, 618 parts (6 equivalents), is then added over 4 hours. Water, 1000 parts, is added at 70° C. and the mixture is heated to reflux for 1 hour. All volatiles are then removed under vacuum at 155° C. and the residue is filtered at that temperature, with the addition of a filter aid material. The filtrate is the desired product (59% solution in mineral oil) containing 3.56% phenolic hydroxyl and 3.46% sulfur.

EXAMPLE B-19

A mixture of 319.2 parts (1.2 equivalents) of a tetrapropene-substituted phenol similar to that used in Example B-18, 240 parts of mineral oil and 45 parts (0.6 equivalent) of 40% aqueous formaldehyde solution is heated to 70° C., with stirring, and 100.5 parts (1.26 equivalents) of 50% aqueous sodium hydroxide is added over about 20 minutes, while the mixture is blown with nitrogen. Volatile materials are removed by stripping at 160° C., with nitrogen blowing and subsequently under vacuum. Sulfur dichloride, 61.8 parts (1.2 equivalents), is added below the surface of the liquid at 140°–150° C., over 6 hours. The mixture is then heated at 145° C. for one hour and volatile materials are removed by stripping under nitrogen at 160° C.

The intermediate thus obtained is filtered with the addition of a filter aid material, and 3600 parts (7.39 equivalents) thereof is combined with 1553 parts of mineral oil and 230 parts of the polyisobutenyl succinic anhydride of Example B-2. The mixture is heated to 67° C. and there are added 142 parts of acetic acid, 1248 parts of methanol and 602 parts (16.27. equivalents) of calcium hydroxide. The mixture is digested for a few minutes and then blown with carbon dioxide at 60°–65° C. The carbon dioxide-blown material is stripped at 160° C. to remove volatiles and finally filtered with the addition of a filter aid. The filtrate is the desired product containing 1.68% sulfur and 16.83% calcium sulfate ash.

EXAMPLE B-20

To a mixture of 3192 parts (12 equivalents) of tetrapropenyl-substituted phenol, 2400 parts of mineral oil and 465 parts (6 equivalents) of 40% aqueous formaldehyde at 82° C., is added, over 45 minutes, 960 parts (12 equivalents) of 50% aqueous sodium hydroxide. Volatile materials are removed by stripping as in Example B-18, and to the residue is added 618 parts (12 equivalents) of sulfur dichloride over 3 hours. Toluene, 1000 parts, and 1000 parts of water are added and the mixture is heated under reflux for 2 hours. Volatile materials are then removed at 180° C. by blowing with nitrogen and the intermediate is filtered.

To 1950 parts (4 equivalents) of the intermediate thus obtained is added 135 parts of the polyisobutenyl succinic anhydride of Example B-2. The mixture is heated to 51° C., and 78 parts of acetic acid and 431 parts of methanol are added, followed by 325 parts (8.8 equivalents) of calcium hydroxide. The mixture is blown with carbon dioxide and is finally stripped with nitrogen blowing at 158° C. and filtered while hot, using a filter aid. The filtrate is a 68% solution in mineral oil of the desired product and contains 2.63% sulfur and 22.99% calcium sulfate ash.

EXAMPLE B-21

A reaction mixture comprising about 512 parts by weight of a mineral oil solution containing about 0.5 equivalent of a substantially neutral magnesium salt of an alkylated salicylic acid wherein the alkyl group has an average of about 18 aliphatic carbon atoms and about 30 parts by weight of an oil mixture containing about 0.037 equivalent of an alkylated benzenesulfonic acid together with about 15 parts by weight (about 0.65 equivalent) of a magnesium oxide and about 250 parts by weight of xylene is added to a flask and heated to a temperature of about 60° C. to 70° C. The reaction mass is subsequently heated to about 85° C. and approximately 60 parts by weight of water are added. The reaction mass is held at a reflux temperature of about 95° C. to 100° C. for about 1½ hours and subsequently stripped at a temperature of 155° C.–160° C., under a vacuum, and filtered. The filtrate comprises the basic carboxylic magnesium salt characterized by a sulfated ash content of 12.35% (ASTM D-874, IP 163), indicating that the salt contains 200% of the stoichiometrically equivalent amount of magnesium.

EXAMPLE B-22

A reaction mixture comprising about 506 parts by weight of a mineral oil solution containing about 0.5 equivalent of a substantially neutral magnesium salt of an alkylated salicylic acid wherein the alkyl groups have an average of about 16 to 24 aliphatic carbon atoms and about 30 parts by weight of an oil mixture containing about 0.037 equivalent of an alkylate benzenesulfonic acid together with about 22 parts by weight (about 1.0 equivalent) of a magnesium oxide and about 250 parts by weight of xylene is added to a flask and heated to temperatures of about 60° C. to 70° C. The reaction is subsequently heated to about 85° C. and approximately 60 parts by weight of water are added to the reaction mass which is then heated to the reflux temperature. The reaction mass is held at the reflux temperature of about 95°–100° C. for about 1½ hours and subsequently stripped at about 155° C., under 40 torr and filtered. The filtrate comprises the basic carboxylic magnesium salts and is characterized by a sulfated ash content of 15.59% (sulfated ash) corresponding to 274% of the stoichiometrically equivalent amount.

EXAMPLE B-23

A substantially neutral magnesium salt of an alkylated salicylic acid wherein the alkyl groups have from 16 to 24 aliphatic carbon atoms is prepared by reacting approximately stoichiometric amounts of magnesium chloride with a substantially neutral potassium salt of said alkylated salicylic acid. A reaction mass comprising approximately 6580 parts by weight of a mineral oil solution containing about 6.50 equivalents of said substantially neutral magnesium salt of the alkylated salicylic acid and about 388 parts by weight of an oil mixture containing about 0.48 equivalent of an alkylated benzenesulfonic acid together with approximately 285 parts by weight (14 equivalents) of a magnesium oxide and approximately 3252 parts by weight of xylene is added to a flask and heated to temperatures of about 55° C. to 75° C. The reaction mass is then heated to about 82° C. and approximately 780 parts by weight of water are added to the reaction which is subsequently heated to the reflux temperature. The reaction mass is held at the reflux temperature of about 95°–100° C. for about 1 hour and subsequently stripped at a temperature of about 170° C., under 50 torr and filtered. The filtrate comprises the basic carboxylic magnesium salts and has a sulfated ash content of 15.7% (sulfated ash) corresponding to 276% of the stoichiometrically equivalent amount.

EXAMPLE B-24

A reaction vessel is charged with 1122 parts (2 equivalents) of a polybutenyl-substituted succinic anhydride derived from a polybutene (Mn=1000), 105 parts (0.4 equivalent) of tetrapropenyl phenol, 1122 parts of xylene and 1000 grams of 100 neutral mineral oil. The mixture is stirred and heated to 80° C. under nitrogen. Then, 580 parts of a 50% aqueous solution of sodium hydroxide is added to the vessel over 10 minutes. The mixture is heated from 80° C. to 120° C. over 1.3 hours. Water is removed by azeotropic reflux and the temperature rises to 150° C. over 6 hours while 300 parts of water is collected. (1) The reaction mixture is cooled to 80° C. where 540 parts of a 50% aqueous solution of sodium hydroxide is added to the vessel. (2) The reaction mixture is heated to 140° C. over 1.7 hours and water is removed at reflux conditions. (3) The reaction mixture is carbonated at 1 standard cubic foot per hour (scfh) while removing water for 5 hours. Steps (1)–(3) are repeated using 560 parts of an aqueous sodium hydroxide solution. Steps (1)–(3) are repeated using 640 parts of an aqueous sodium hydroxide solution. Steps (1)–(3) are then repeated with another 640 parts of a 50% aqueous sodium hydroxide solution. The reaction mixture is cooled and 1000 parts of 100 neutral mineral oil are added to the reaction mixture. The reaction mixture is vacuum stripped to 115° C., about 30 millimeters of mercury. The residue is filtered through diatomacous earth. The filtrate has a total base number of 361 (theoretical 398), 43.4% sulfated ash (theoretical 50.3), 39.4% oil and a specific gravity of 1.11.

EXAMPLE B-25

A reaction vessel is charged with 700 parts of a 100 neutral mineral oil, 700 parts (1.25 equivalents) of the succinic anhydride of Example B-24 and 200 parts (2.5 equivalents of a 50% aqueous solution of sodium hydroxide. The reaction mixture is stirred and heated to 80° C. where 66 parts (0.25 equivalent) of tetrapropenyl phenol are added to the reaction vessel. The reaction mixture is heated from 80° C. to 140° C. over 2.5 hours with blowing of nitrogen and removal of 40 parts of water. Carbon dioxide (28 parts, 1.25 equivalents) is added over 2.25 hours at a temperature from 140–165° C. The reaction mixture is blown with nitrogen at 2 standard cubic foot per hour (scfh) and a total of 112 parts of water is removed. The reaction temperature is decreased to 115° C. and the reaction mixture is filtered through diatomaceous earth. The filtrate has 4.06% sodium (theoretical 3.66), a total base number of 89, a specific gravity of 0.948 and 44.5% oil.

EXAMPLE B-26

A reaction vessel is charged with 281 parts (0.5 equivalent) of the succinic anhydride of Example B-24, 281 parts of xylene, 26 parts of tetrapropenyl substituted phenol and 250 parts of 100 neutral mineral oil. The mixture is heated to 80° C. and 272 parts (3.4 equivalents) of an aqueous sodium hydroxide solution are added to the reaction mixture. The mixture is blown with nitrogen at 1 scfh and the reaction temperature is increased to 148° C. The reaction mixture is then blown with carbon dioxide at 1 scfh for one hour and 25 minutes while 150 parts of water is collected. The reaction mixture is cooled to 80° C. where 272 parts (3.4 equivalents) of the above sodium hydroxide solution is added to the reaction mixture and the mixture is blown with nitrogen at 1 scfh. The reaction temperature is increased to 140° C. where the reaction mixture is blown with carbon dioxide at 1 scfh for 1 hour and 25 minutes while 150 parts of water is collected. The reaction temperature is decreased to 100° C. and 272 parts (3.4 equivalents) of the above sodium hydroxide solution is added while blowing the mixture with nitrogen at 1 scfh. The reaction temperature is increased to 148° C. and the reaction mixture is blown with carbon dioxide at 1 scfh for 1 hour and 40 minutes while 160 parts of water is collected. The reaction mixture is cooled to 90° C. and where 250 parts of 100 neutral mineral oil are added to the reaction mixture. The reaction mixture is vacuum stripped at 70° C. and the residue is filtered through diatomaceous earth. The filtrate contains 50.0% sodium sulfate ash (theoretical 53.8) by ASTM D-874, total base number of 408, a specific gravity of 1.18 and 37.1% oil.

EXAMPLE B-27

A reaction vessel is charged with 700 parts of the product of Example B-26. The reaction mixture is heated to 75° C. where 340 parts (5.5 equivalents) of boric acid is added over 30 minutes. The reaction mixture is heated to 110° C. over 45 minutes and the reaction temperature is maintained for 2 hours. A 100 neutral mineral oil (80 parts) is added to the reaction mixture. The reaction mixture is blown with nitrogen at 1 scfh at 160° C. for 30 minutes while 95 parts of water is collected. Xylene (200 parts) is added to the reaction mixture and the reaction temperature is maintained at 130–140° C. for 3 hours. The reaction mixture is vacuum stripped at 150° C. and 20 millimeters of mercury. The residue is filtered through diatomaceous earth. The filtrate contains 5.84% boron (theoretical 6.43) and 33.1% oil. The residue has a total base number of 309.

EXAMPLE B-28

A reaction vessel is charged with 224 parts (0.4 equivalents) of the succinic anhydride of Example B-24, 21 parts (0.08 equivalent) of a tetrapropenyl phenol, 224 parts of xylene and 224 parts of 100 neutral mineral oil. The mixture is heated and 212 parts (2.65 equivalents) of a 50% aqueous sodium hydroxide solution are added to the reaction vessel. The reaction temperature increases to 130° C. and 41 parts of water is removed by nitrogen blowing at 1 scfh. The reaction mixture is then blown with carbon dioxide at 1 scfh for 1.25 hours. The sodium hydroxide solution (432 parts, 5.4 equivalents) is added over four hours with carbon dioxide blowing at 0.5 scfh at 130° C. During the addition, 301 parts of water are removed from the reaction vessel. The reaction temperature is increased to 150° C. and the rate of carbon dioxide blowing is increased to 1.5 scfh and maintained for 1 hour and 15 minutes. The reaction mixture is cooled to 150° C. and blown with nitrogen at 1 scfh while 176 parts of oil is added to the reaction mixture. The reaction mixture is blown with nitrogen at 1.8 scfh for 2.5 hours and the mixture is then filtered through diatomaceous earth. The filtrate contains 15.7% sodium and 39% oil. The filtrate has a total base number of 380.

EXAMPLE B-29

A reaction vessel is charged with 561 parts (1 equivalent) of the succinic anhydride of Example B-24, 52.5 parts (0.2 equivalent) of a tetrapropenylphenol, 561 parts xylene and 500 parts of a 100 neutral mineral oil. The mixture is heated to 50° C. under nitrogen and 373.8 parts (6.8 equivalents) of potassium hydroxide and 299 parts of water are added to the mixture. The reaction mixture is heated to 135° C. while 145 parts of water is removed. The azeotropic distillate is clear. Carbon dioxide is added to the reaction mixture at 1 scfh for two hours while 195 parts of water is removed azeotropically. The reaction is cooled to 75° C. where a second portion of 373.8 parts of potassium hydroxide and 150 parts of water are added to the reaction vessel. The reaction mixture is heated to 150° C. with azeotropic removal of 70 parts of water. Carbon dioxide (1 scfh) is added for 2.5 hours while 115 parts of water is removed azeotropically. The reaction is cooled to 100° C. where a third portion of 373.8 parts of potassium hydroxide and 150 parts of water is added to the vessel. The reaction mixture is heated to 150° C. while 70 parts of water is removed. The reaction mixture is blown with carbon dioxide at 1 scfh for one hour while 30 parts of water is removed. The reaction temperature is decreased to 70° C. The reaction mixture is reheated to 150° C. under nitrogen. At 150° C. the reaction mixture is blown with carbon dioxide at 1 scfh for two hours while 80 parts of water is removed. The carbon dioxide is replaced with a nitrogen purge and 60 parts of water is removed. The reaction is then blown with carbon dioxide at 1 scfh for three hours with removal of 64 parts of water. The reaction mixture is cooled to 75° C. where 500 parts of 100 neutral mineral is added to the reaction mixture. The reaction is vacuum stripped to 115° C. and 25 millimeters of mercury. The residue is filtered through diatomacious earth. The filtrate contains 35% oil and has a base number of 322.

The invention also contemplates the use of other additives in combination with the compositions of this invention. Such additives include, for example, dispersants of the ash-producing or ashless type, corrosion- and oxidation-inhibiting agents, pour point depressing agents, auxiliary extreme pressure agents, color stabilizers, friction modifiers and anti-foam agents.

Ashless dispersants are so called despite the fact that, depending on its constitution, the dispersant may upon combustion yield a non-volatile material such as boric oxide or phosphorus pentoxide; however, it does not ordinarily contain metal and therefore does not yield a metal-containing ash on combustion. Many types are known in the art, and any of them are suitable for use in the lubricants of this invention. The following are illustrative:

| | | |
|---|---|---|
| 3,163,603 | 3,351,552 | 3,522,179 |
| 3,184,474 | 3,381,022 | 3,541,012 |
| 3,215,707 | 3,399,141 | 3,542,678 |
| 3,219,666 | 3,415,750 | 3,542,680 |
| 3,271,310 | 3,433,744 | 3,567,637 |
| 3,281,357 | 3,444,170 | 3,574,101 |
| 3,306,908 | 3,448,048 | 3,576,743 |
| 3,311,558 | 3,448,049 | 3,630,904 |
| 3,316,177 | 3,451,933 | 3,632,510 |
| 3,340,281 | 3,454,607 | 3,632,511 |
| 3,341,542 | 3,467,668 | 3,697,428 |
| 3,346,493 | 3,501,405 | 3,725,441 |
| | | Re 26,433 |

(2) "Amine dispersants" and "Mannich dispersants" such as those described hereinabove.

(3) Products obtained by post-treating the carboxylic, amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Patents:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |

-continued

| | | | |
|---|---|---|---|
| 3,216,936 | 3,367,943 | 3,533,945 | 3,658,836 |
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,522 |

(4) Interpolymers of oil-solubilizing monomers such as decyl methacrylate, vinyl decyl ether and high molecular weight olefins with monomers containing polar substituents, e.g., aminoalkyl acrylates or acrylamides and poly (oxyethylene)-substituted acrylates. These may be characterized as "polymeric dispersants" and examples thereof are disclosed in the following U.S. patents:

| | |
|---|---|
| 3,329,658 | 3,666,730 |
| 3,449,250 | 3,687,849 |
| 3,519,565 | 3,702,300 |

The above-noted patents are incorporated by reference herein for their disclosures of ashless dispersants.

Auxiliary extreme pressure agents and corrosion- and oxidation-inhibiting agents are exemplified by chlorinated aliphatic hydrocarbons such as chlorinated wax; aromatic or arylaliphatic sulfides and polysulfides such as benzyl disulfide, bis(chlorobenzyl) disulfide and sulfurized alkylphenol; phosphosulfurized hydrocarbons such as the reaction product of a phosphorus sulfide with turpentine or methyl oleate; phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl) phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

The compositions of the present invention have been found to be a useful friction modifier for lubricating compositions.

The composition of the invention may be formulated with a lubricating oil by the direct blending of the composition with the particular oil to be formulated. The lubricating oil may also be formulated with compounds of the present invention in the form of a concentrate. Such a concentrate may be prepared by adding 1% to about 99% by weight of the components (A) or (A') and (B) to a substantially inert, normally liquid organic diluent or solvent such as benzene, toluene, xylene, petroleum naphtha, mineral oil, ethylene-glycol-mono-methlether or the like.

The amount of (A) or (A') and (B) formulated with a particular lubricant may vary over a wide range and must be an amount to effectively impart friction modification properties in the lubricant. As a preferred amount, the (A) or (A') and (B) may range from about 0.01 weight percent to about 10 weight percent of the formulated lubricant. In a most preferred embodiment, the amount may range from about 0.1 weight percent to about 5 weight percent of the formulated lubricant. The weight ratio of (A) or (A'):B is generally from about 0.01–2:1, preferably from about 0.03–0.75:1 and most preferably from about 0.05–0.10:1.

The novel composition of this invention was tested for its effectiveness as a fuel economy agent in a fully formulated lubricating oil composition. Table II below outlines examples so as to provide those of ordinary skill in the art with a complete disclosure and description on how to make the friction modifier composition of this invention and is not intended to limit the scope of what the inventor regards as his invention. All parts are by weight. In this Table II, Example 1 is a comparative or baseline example that does not contain (A) or (A'). The below formulations also contain 80 parts per million of a silicon antifoamant.

Energy conserving properties of this invention were evaluated using the ASTM Sequence VI Gasoline Fuel Efficient Oil Test. This test evaluates the energy conserving properties of oil formulations and provides an Equivalent Fuel Economy Index (EFEI) for the energy conserving properties of the formulation. The higher the EFEI the greater the energy conserving properties of the formulation.

TABLE II[1]

| COMPONENT/EXAMPLE | 1 | 2 | 3 | 4 |
|---|---|---|---|---|
| Base Oil | 94.31 | 94.31 | 94.31 | 94.31 |
| Viscosity Index Improver | 0.51 | 0.51 | 0.51 | 0.51 |
| Pour Point Depressant | 0.08 | 0.08 | 0.08 | 0.08 |
| Zinc dialkyl phosphoro-dithioate | 1.01 | 1.01 | 1.01 | 1.01 |
| Copper dialkyl phosphoro-dithioate | 0.08 | 0.08 | 0.08 | 0.08 |
| Alkyl phenol/ isobutylene (½)m | 0.37 | 0.37 | 0.37 | 0.37 |
| Ashless Dispersant | 2.81 | 2.81 | 2.81 | 2.81 |
| Commercial Fuel Economy Improver | 0.10 | | | |
| High Oleic Sunflower Oil | | 0.10 | | |
| Sunflower Oil | | | 0.10 | |
| Castor Oil | | | | 0.10 |
| Product of Example B-24 | 0.73 | 0.73 | 0.73 | 0.73 |
| EFEI | 2.5 | 2.5 | 3.2 | 2.5 |

[1]The non-oil components are corrected to an oil-free basis

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed:

1. A composition comprising:

(i) an oil of lubricating viscosity; and (ii) a friction-reducing amount of an additive comprising;

(A) about 0.01 to about 5 percent by weight of the composition of sunflower oil, and (B) about 0.1 to about 10 percent by weight of the composition of at least one metal overbased composition;

wherein the weight ratio of (A) to (B) is about 0.03–0.75:1.

2. The composition of claim 1 wherein the weight ratio of (A) to (B) is about 0.05–0.10:1.

3. The composition of claim 1 wherein component (B) comprises a metal overbased composition derived from a hydrocarbyl-substituted succinic acid or anhydride, wherein the hydrocarbyl substituent is derived from a polyalkene having an Mn of at least about 600.

4. The composition of claim 3 wherein the polyalkene has an Mn of about 800 to about 3,000.

5. The composition of claim 3 wherein the polyalkene is polybutene.

6. The composition of claim 1 wherein the metal is an alkali metal or an alkaline earth metal.

7. The composition of claim 1 wherein the metal comprises lithium, sodium or potassium.

8. The composition of claim 1 wherein component (B) is borated.

* * * * *